US005358147A

United States Patent [19]

Adams et al.

[11] Patent Number: 5,358,147

[45] Date of Patent: Oct. 25, 1994

[54] SPRAY DISPENSING PACKAGE

[75] Inventors: Mary B. Adams, Lake County, Ill.; Scott W. Demarest; Allen D. Miller, both of Racine County, Wis.

[73] Assignee: S. C. Johnson & Son, Inc., Racine, Wis.

[21] Appl. No.: 115,389

[22] Filed: Sep. 2, 1993

[51] Int. Cl.[5] ..... B67D 5/06

[52] U.S. Cl. ..... 222/183; 222/325; 222/402.13

[58] Field of Search ..... 222/182, 183, 162, 402.1, 222/321, 402.13, 402.2, 325

[56] References Cited

U.S. PATENT DOCUMENTS

| | | | |
|---|---|---|---|
| 2,966,283 | 12/1960 | Darvie . | |
| 2,988,165 | 8/1961 | De Elorza | 222/402.13 X |
| 3,101,160 | 8/1963 | Picot . | |
| 3,128,916 | 4/1964 | Picot . | |
| 3,272,391 | 9/1966 | Meshberg . | |
| 3,272,392 | 9/1966 | Meshberg . | |
| 3,347,423 | 10/1967 | Rahn et al. | 222/183 |
| 3,431,749 | 3/1969 | Bounds | 222/402.13 X |
| 3,506,004 | 4/1970 | Mann et al. | 222/402.13 X |
| 3,549,055 | 12/1970 | Gatland | 222/402.13 X |
| 3,582,261 | 6/1971 | Price . | |
| 3,762,611 | 10/1973 | Nigro | 222/402.13 |
| 3,884,398 | 5/1975 | McLaughlin | 222/402.13 |
| 4,277,004 | 7/1981 | Barlics | 222/402.13 X |
| 4,416,399 | 11/1983 | Parr et al. | 222/402.13 |
| 4,849,606 | 7/1989 | Martens . | |
| 5,048,729 | 9/1991 | Pritchard | 222/402.2 X |
| 5,147,073 | 9/1992 | Cater | 222/402.2 X |

FOREIGN PATENT DOCUMENTS

| | | | |
|---|---|---|---|
| 612876 | 1/1961 | Canada | 222/402.13 |
| 2456651 | 6/1975 | Fed. Rep. of Germany | 222/402.13 |
| WO92/04419 | 3/1992 | PCT Int'l Appl. . | |
| 1471253 | 4/1977 | United Kingdom | 222/402.13 |

*Primary Examiner*—Kevin P. Shaver

[57] ABSTRACT

A spray dispensing package comprising: an outer shell; and a refill cartridge that fits within the outer shell. The refill cartridge includes a spray container which has a body and a spray valve which includes a valve stem. The refill cartridge has a base, and a spray nozzle, and the spray nozzle is fitted over the spray container in fluid communication with the valve stem. The spray nozzle is also attached to the can body with a sufficient range of motion to allow the spray valve to be actuated when pressure is applied to the top surface of the shell. The shell has a top surface and an opening in the top surface to receive the spray nozzle such that a spray can exit the spray nozzle to the atmosphere and such that the shell is supported by the refill cartridge. The shell also has guide surfaces which cooperate with the refill cartridge to allow the shell to slide smoothly relative to the refill cartridge when pressure is applied to the top surface of the shell.

17 Claims, 9 Drawing Sheets

FIG. 6
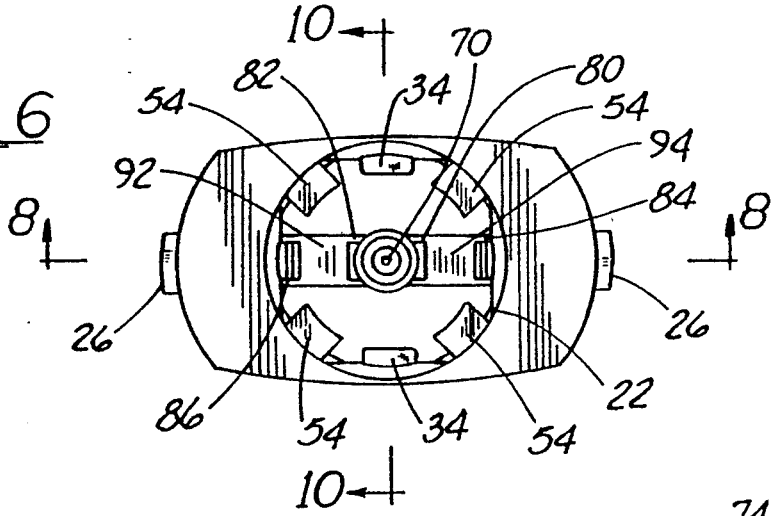
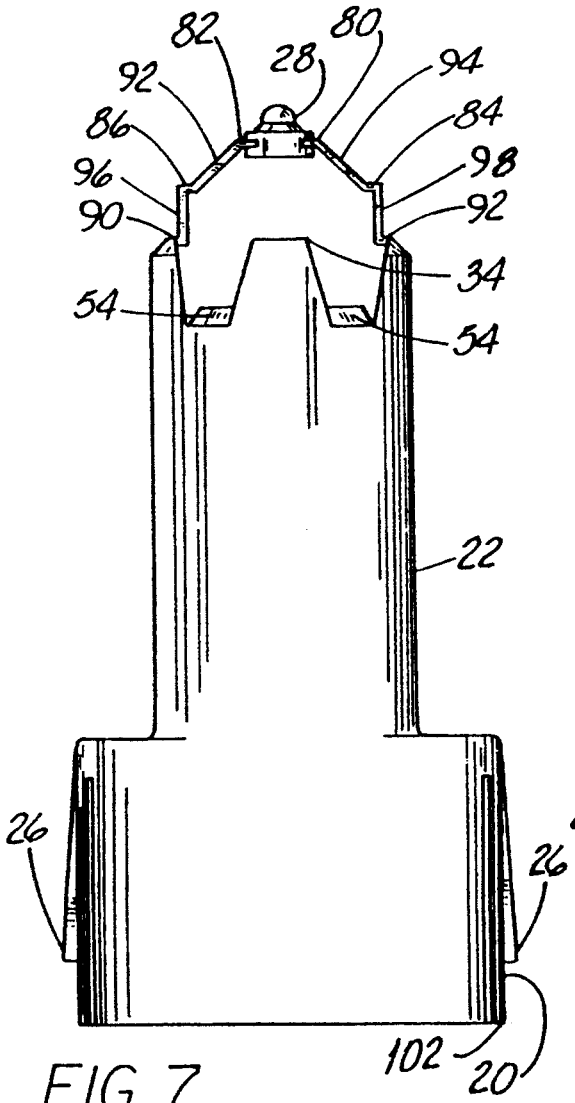
FIG. 7
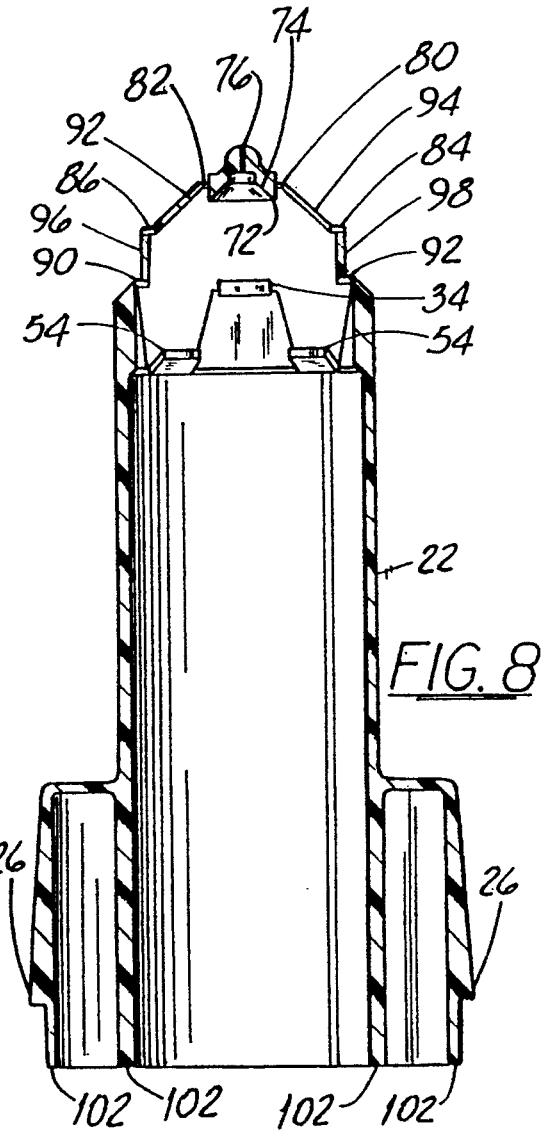
FIG. 8

FIG. 13
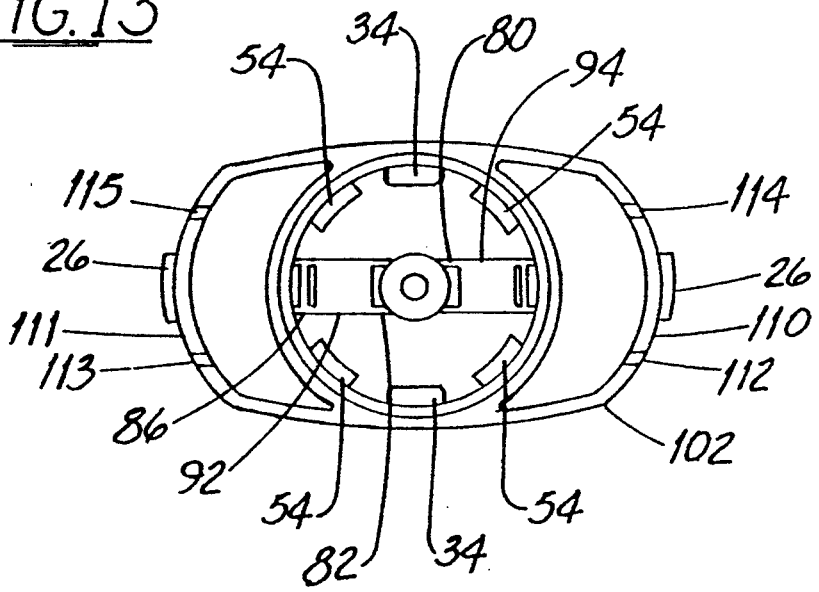
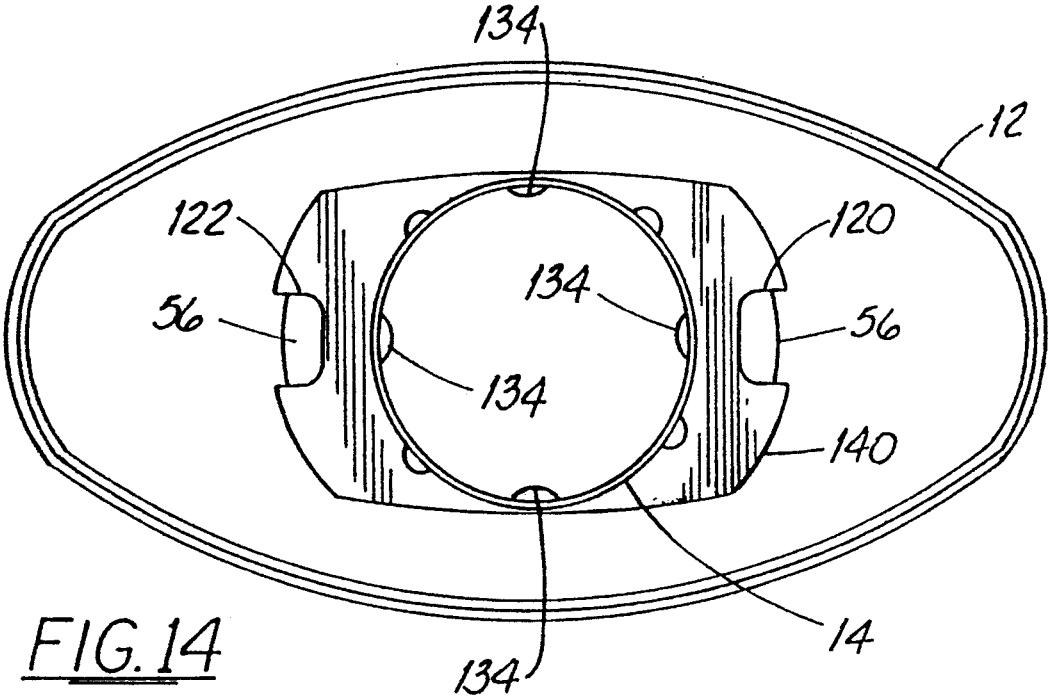
FIG. 14

SPRAY DISPENSING PACKAGE

TECHNICAL FIELD

This invention relates to consumer package goods, in particular, to consumer package goods in the form of a spray device designed to dispense or spray perfume and other compositions into the atmosphere to freshen the air.

BACKGROUND OF THE INVENTION

In the past air freshening devices have been characterized either as instant action aerosol sprays or continuous action products such as various gels which contain perfume and which last for 20–60 days. While those instant action sprays and continuous action gels are effective, there are times when both an instant action and continuous action are needed at similar times. Prior devices and compositions have been unable to provide an instant action air freshener with a long lasting effect.

PCT published Application No. W092/04419 discloses aerosol compositions packaged within a metering valve aerosol having a high level of perfume. Formulations as described in this patent can be used in the device of the present invention.

U.S. Pat. No. 4,849,606 describes an electric warming unit into which the cartridges containing a gel air freshener are inserted, the gel having a film coating through which the perfume permeates to freshen the air.

U.S. Pat. No. 3,272,391 and 3,272,392 disclose aerosol container dispensers which are activated by side finger pressure.

U.S. Pat. No. 3,347,423 discloses an aerosol container that is completely enclosed within a shroud U.S. Pat. No. 3,128,916 discloses an aerosol spray which can incorporate refills.

None of the above patents disclose a dispensing container of the type described in this application.

SUMMARY OF INVENTION

This invention relates to a spray dispensing which comprises an outer shell; and a cartridge that fits within that outer shell, the refill cartridge including a spray container having a can body and a valve includes a valve stem;

wherein the refill cartridge has a base, and a spray nozzle, the spray nozzle being fitted over the spray container in fluid communication with the valve stem, the spray nozzle being attached to the can body by flexible means;

the shell having a top surface and an opening in the top surface to receive the spray nozzle such that a spray can exit the spray nozzle to the atmosphere and such the shell is supported by the refill cartridge;

the hinge means having a sufficient range of motion to allow the aerosol valve to be actuated when pressure is applied to the top surface of the shell;

the shell further having guide means which cooperate with the refill cartridge to allow the shell to slide smoothly relative to the refill cartridge when pressure is applied to the top surface of the shell.

This dispensing container allows the use of a decorative outer shell or shroud which can be refilled using lower-cost spray refills. The package operates by pressing down on the top surface which moves the entire outer shell downward, flexing the flexible members and allowing the spray nozzle to depress and actuate the spray valve.

This invention also relates to the refills as described above.

DESCRIPTION OF THE DRAWINGS

FIG. 6 is a top view of the refill cartridge without the spray can.

FIG. 7 is a side view of the refill cartridge without the spray can.

FIG. 8 is a cross-sectional view taken along the lines 8—8 in FIG. 6.

FIG. 13 is a bottom view of the refill cartridge without the spray can.

FIG. 14 is a top view of the bottom shell.

DESCRIPTION OF THE PREFERRED EMBODIMENT

Figure 1:
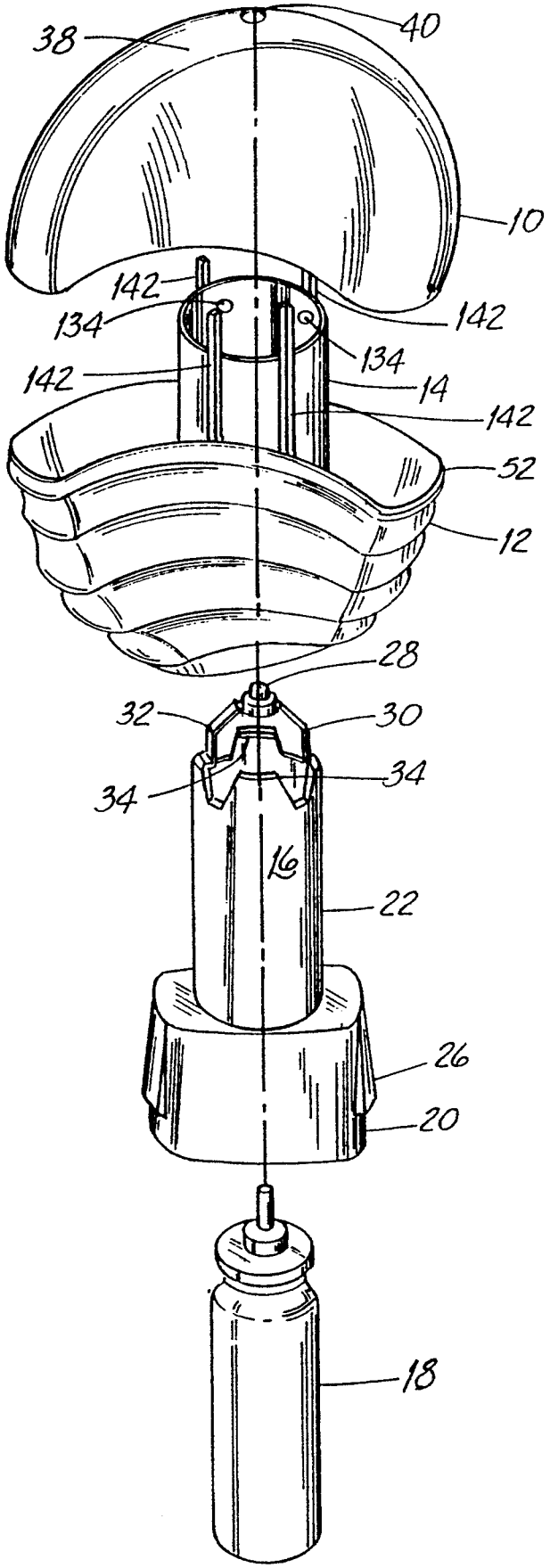
FIG. 1, is an exploded three-quarter perspective view from the bottom of the package of the present invention.
Figure 2:
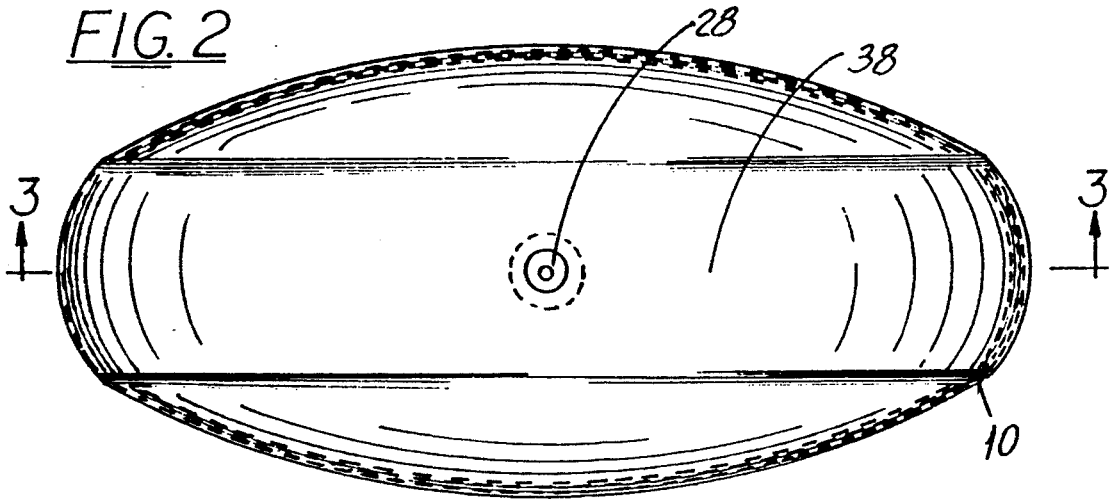
FIG. 2 is a top view of the dispensing container.

FIG. 1 is an exploded view showing the 4 components of a complete device of the present invention. These 4 components are top shell 10, bottom shell 12, refill shroud 16 and spray container 18. When assembled, top shell 10 and bottom shell 12 can preferably have exterior ornamentation to provide a decorative appearance.

With reference to FIGS. 3, 5, 6, 8 and 10, spray container 18 is inserted into shroud 16 so that valve stem 62 is guided into valve stem receiving socket 74 of refill spray nozzle 28. Spray can 18 is formed from can body 60 onto which a standard spray valve, such as an aerosol valve which may be a metering valve, or a pump spray valve, having valve stem 62 is crimped by means of valve crimp 64. The spray valve body has a top surface 66. When spray can 18 is inserted into refill shroud 16, it slides along the interior of shroud wall 22 until the top surface 66 of the spray valve contacts stop surfaces 34. At the same time the top surface 66 contacts stop surfaces 34, undercuts 54 (of which four are shown in the Figures) flex to allow the valve to pass by and then flex back and engage the crimp surface 64 to firmly hold the spray container with valve stem 62 in fluid communication with spray nozzle orifice 70. Undercuts 54 and stop surfaces 34 firmly lock spray container 18 in position within shroud 16.

Shroud 16, in addition to undercuts 54 and stop surfaces 34 has shroud wall 22 as noted above which completely surrounds spray container 18. At the top end of shroud wall 22 is attached to hinging mechanisms 30 and 32 as shown in FIG. 1 and shown in more detail in FIGS. 3, 6, 7, 8, 11, 12 and 13. Shroud 16 has a base 20 as shown in FIGS. 1, 3, 4 and 5 which has a bottom surface 102 as shown in FIGS. 3, 4, 5, 7, 8, 10 and 13. When fully assembled, the device rests on bottom surface 102 of base 20. Base 20 of shroud 16 is preferably of a different dimension and geometry than shroud wall 22. As shown in the figures, base 20 has a generally elongated shape as compared with shroud wall 22. The base shape has three functions. First, it provides a wider and more stable support for the device; second, it allows the user to insert the refill cartridge into the outer shell in only one of two correct positions; and, third, it cooperates with guide channels 14, 42 and 140 to allow the outer shell to slide smoothly and relative to shroud wall 22 and base 20 when the device is actuated.

Figure 3:
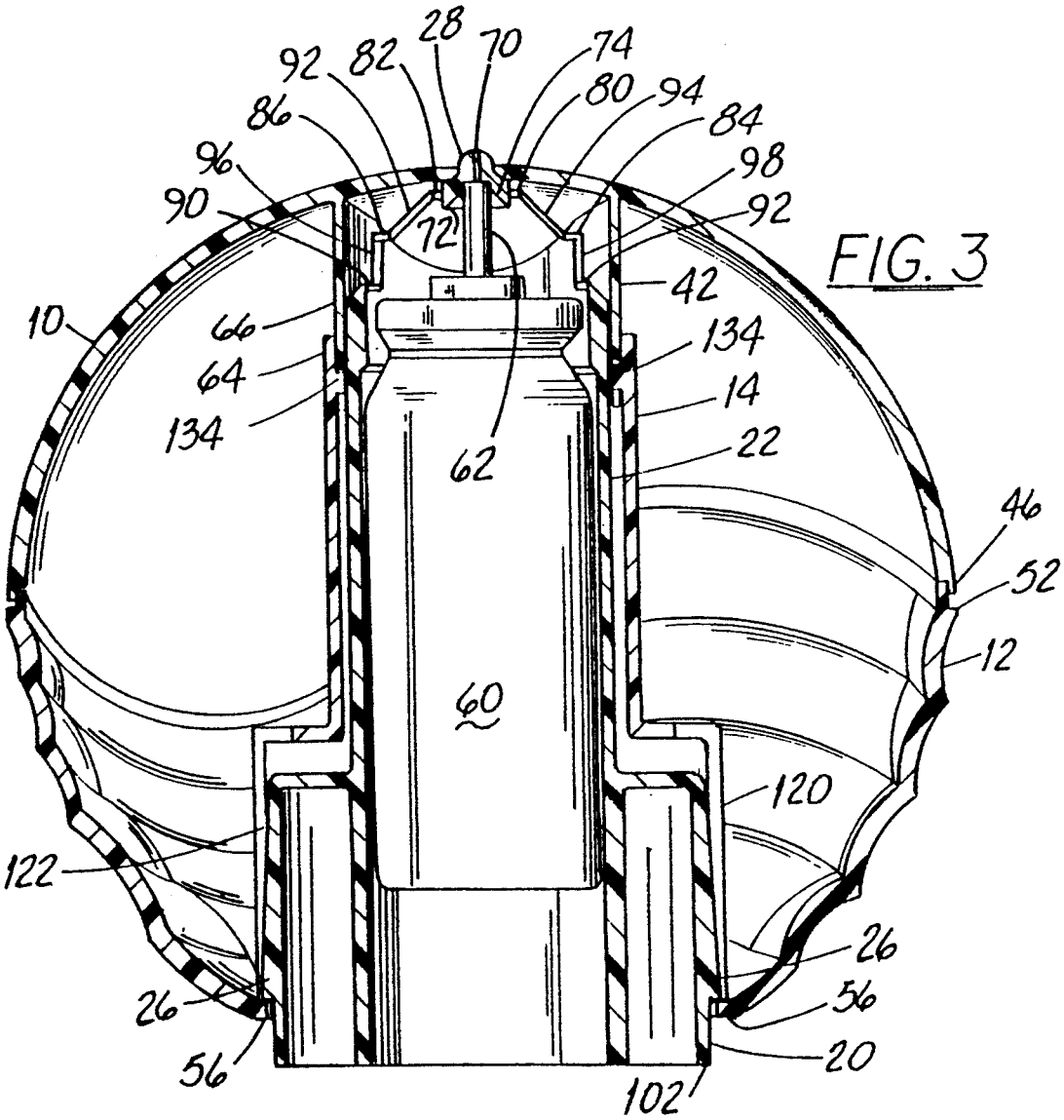
FIG. 3 is a sectional view taken along lines 3—3 in FIG. 2.
Figure 5:
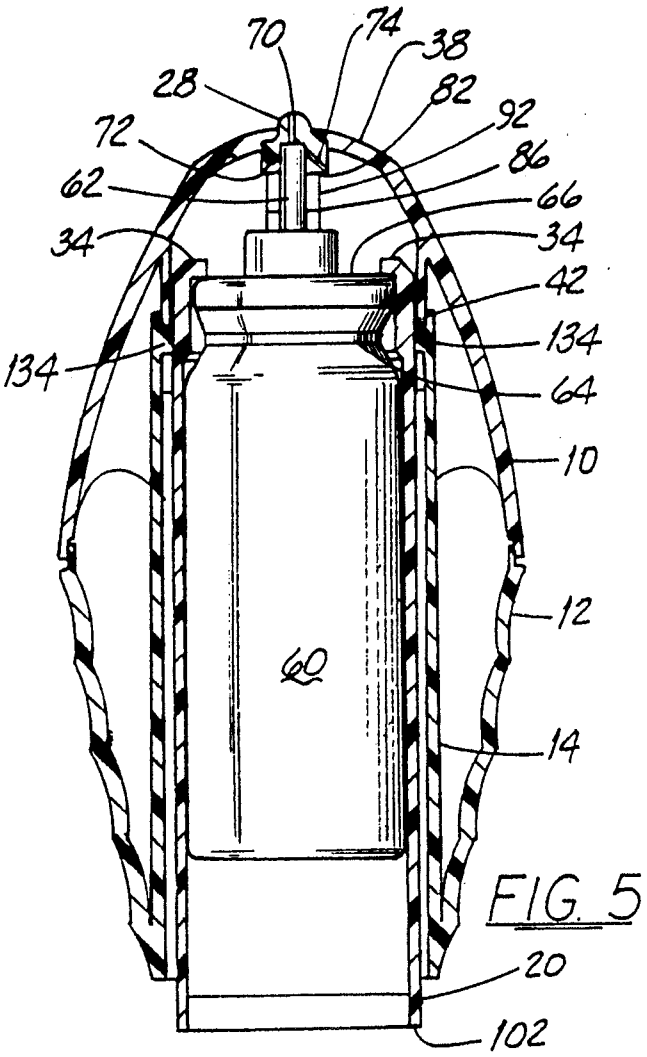
FIG. 5 is a cross-sectional view taken along the lines 5—5 in FIG. 4.

Also included in base 20 is a pair of flexible locking members 26 as shown in FIGS. 1, 3, 7, 8, 9 and 13. When the refill cartridge is inserted into the outer shell, locking members 26 pass over locking ledges 56 in bottom shell as shown in FIGS. 3 and 14. Locking members 26 flex as they pass over ledges 56 by means of slots 111, 112, 113 and 114. This gives locking members 26 the flexibility to move over ledge 56. To remove the refill cartridge from the shell, the user pushes on surfaces 110 to flex locking members 26 inward so that the refill cartridge can be removed from the shell.

Figure 15:
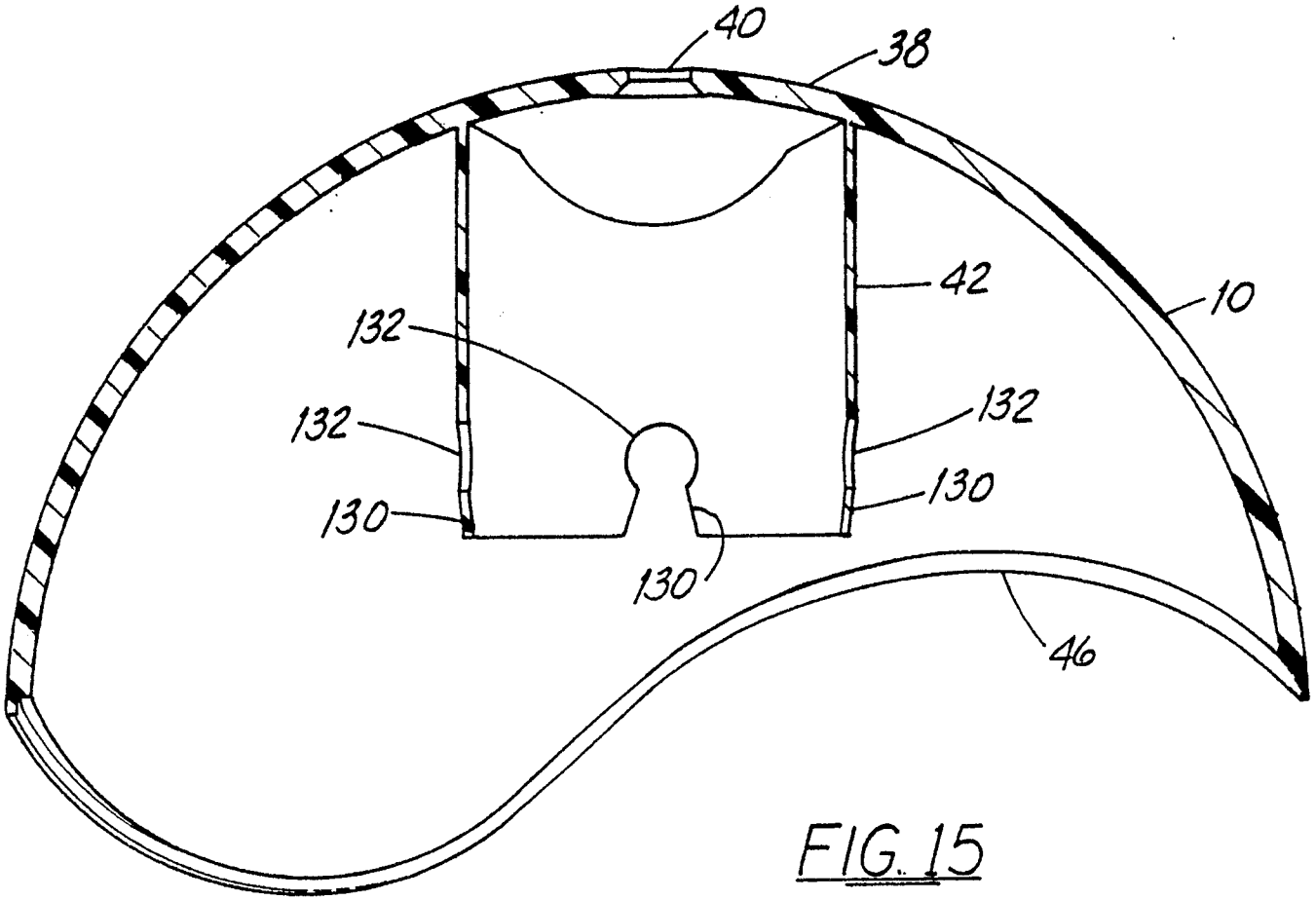
FIG. 15 is a cross-sectional view of the top shell only taken along line 3—3 in FIG. 2.

Outer shells 10 and 12 also can be joined together by other mechanical joining means conventional in the art. The joining means as shown in FIGS. 3, 5, 14 and 15 include a series of keyways 130 having an enlarged keyhole 132 in each keyway. This is best shown in FIG. 15 which shows a cross-sectional view of top shell 10. Top shell 10 and bottom shell 12 are forced together during assembly in manufacturing. Guide posts 142 fit over the outside of top shell guide channel 42 to guide the top and bottom shells together during manufacturing assembly. A similar number of key detents 134 contained in the top interior surface of bottom shell guide 14 mate with the keyways 130 and when forced up, mate into keyholes 132 forming a tight fit which can not be easily separated. Other assembly methods for joining outer shells 10 and 12 that can be used include such conventional assembly methods as slots and undercuts as well as the use of various solvent, adhesives, and other bonding methods. What is important is that top shell 10 and bottom shell 12 are firmly joined together so that they cannot be disassembled by the ultimate consumer.

Figure 4:
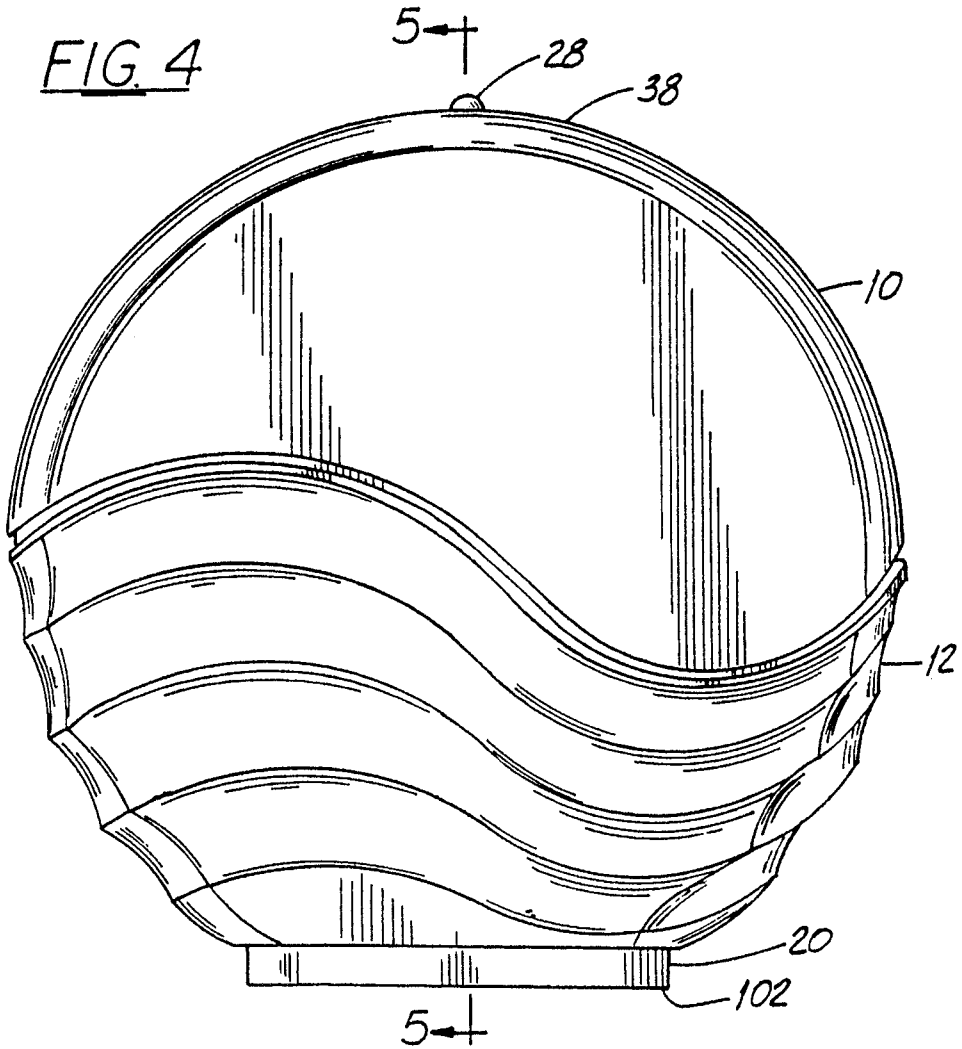
FIG. 4 is a front view of the device of the present invention.
Figure 9:
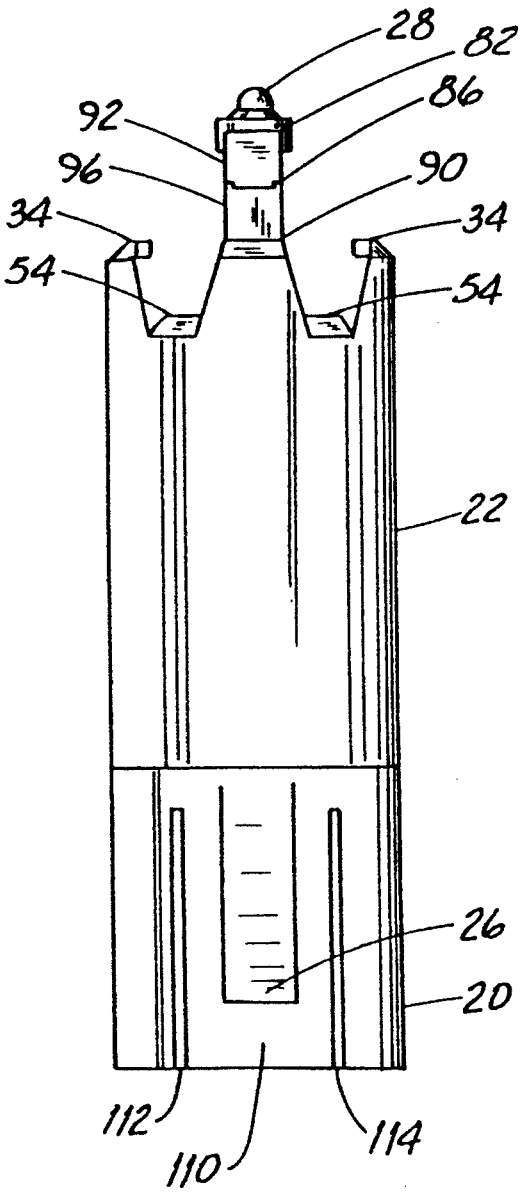
FIG. 9 is a side view of the refill cartridge without the spray can.

Bottom shell guide channel 14 and top shell guide channel 42, when assembled, form a unified guide surface to guide shroud wall 22 of the refill shroud such that the device smoothly slides past each other when a user presses on top surface 38 as shown in FIG. 4. With reference to FIG. 4 which shows a side view of the device fully assembled, to actuate the device and spray the product through refill spray nozzle 28, the user will press on top surface 38 of top shell 10. This depresses spray nozzle 28 and the valve stem by means of guide channels 14, 42 and 140, sliding downwards relative to shroud wall 22 and base 20 toward bottom surface 102 of base 20. It is important that these surfaces to be dimensioned such that shroud wall 22 can easily slide within guide channels 14 and 42 without binding and to prevent any canting action relative to guide channels 14 and 42 and shroud wall 22. The shape of refill shroud 16 further assists in preventing any binding of the dispenser during use.

Spray nozzle 28 is attached to refill shroud 16 by means of flexible members 30 and 32. These flexible members can be any type of flexing device which will allow spray nozzle 28 to be attached to and in fluid communication with valve stem 62 to such a way that the nozzle 28 is not easily removed, although, depending on the dimensions, it may be possible to pull nozzle 28 free of valve stem 62 but nozzle 28 will still be over valve stem 62 and will be forced into communication with valve stem 62 when pressure is applied to nozzle 28. As shown in detail in FIGS. 7, 8, 11 and 12, one preferred configuration of flexing members 30 and 32 comprises a pair of three point hinges having first hinge points 80 and 82 attached to spray nozzle 28 and attaching top support members 92 and 94. These top support members are then attached at the opposite end to a second hinge 84 and 86, respectively. Second hinges 84 and 86, respectively, are then connected to bottom support members 96 and 98. In turn, bottom support members 96 and 98 are attached to shroud wall 22 at the end opposite hinges 84 and 86 by means of hinges 90 and 92. Since all aerosol valves contain an internal spring (not shown), it is not necessary to provide any internal springing to flexing members 30 and 32 although some spring can be built into these flexing members.

Figure 11:
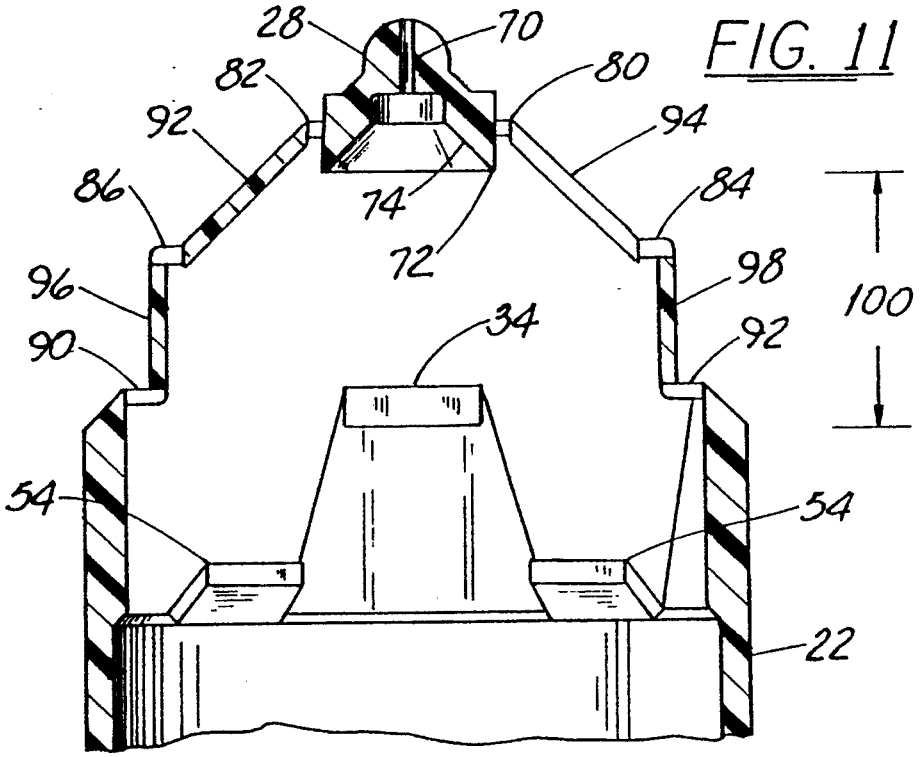
FIG. 11 is a detail view of the flexible member in cross-section as in FIG. 8 but enlarged to show the detail.
Figure 12:
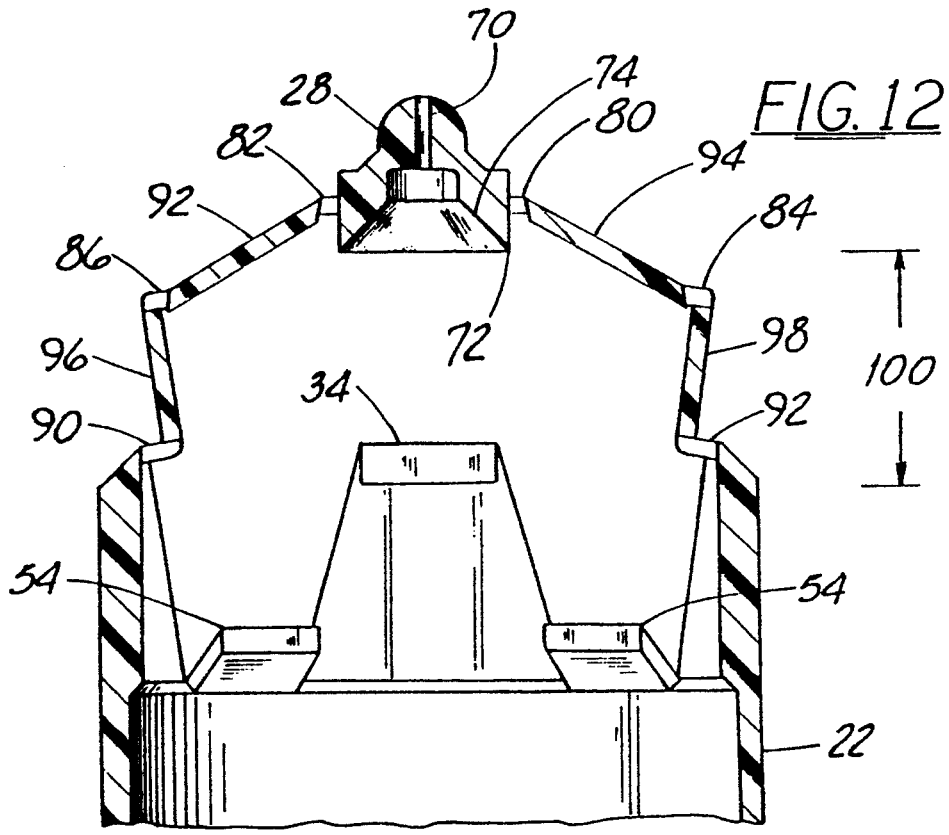
FIG. 12 is a similar view to FIG. 11 but showing the flexible member in the dispensing position.

In the device as shown in the drawings, all that is necessary is that when pressure is applied against nozzle 28, the flexing members will flex to reduce dimension 100 as shown in FIGS. 11 and 12 in such a way that the spray valve is actuated and that fluid flows through valve stem 62 through orifice 70 to the atmosphere.

Figure 10:
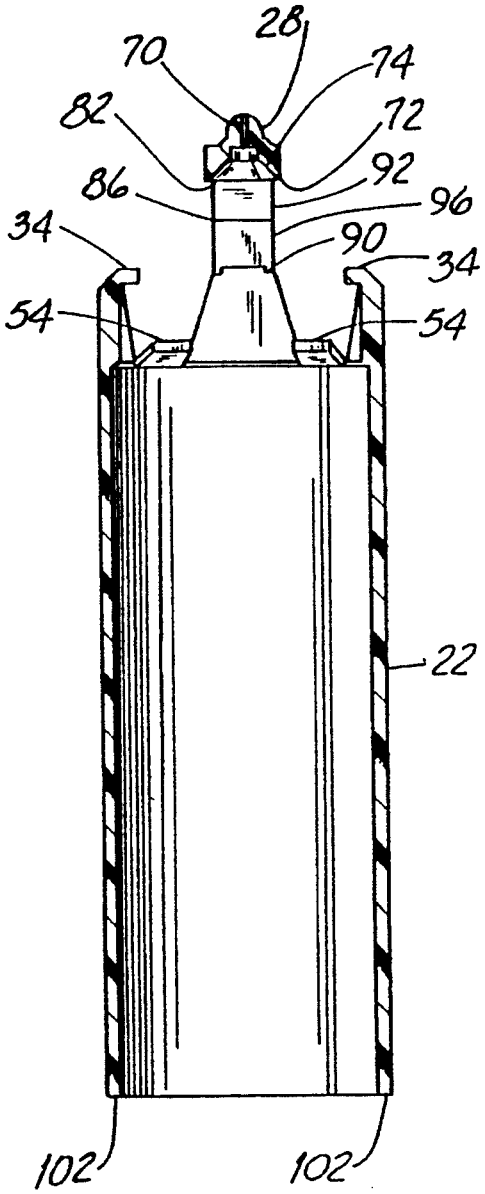
FIG. 10 is a cross-sectional view taken along the lines 10—10 in FIG. 6.

As shown in detail on FIGS. 10, 11 and 12, the three point hinges described in the drawings allow a maximum vertical displacement with a minimum of horizontal travel. This insures a smooth operation of the device.

The spray device used in the refill cartridge can be either an aerosol spray device or a pump spray device. The aerosol spray valve can be either a conventional spray valve or a metering spray valve. The advantage of using a metering valve is that only a predetermined amount of product is dispensed. If a pump spray valve is used, the force of the user pushing on surface 28 must be sufficient to operate a standard and conventional pump spray valve.

Figure 16:
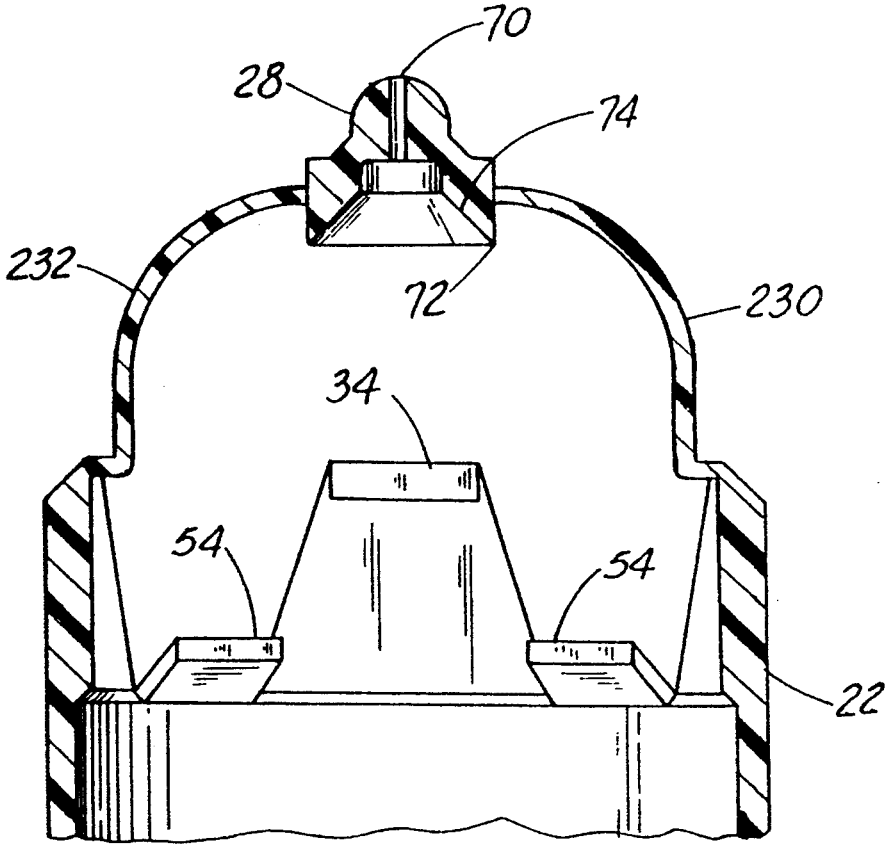
FIG. 16 is a cross-sectional detail view as in FIG. 11 but showing an alternate embodiment of the flexible member.

An alternate embodiment of flexing members 30 and 32 is shown in FIG. 16. In this embodiment the flexing members are each a single flexible strip 230 and 232 which are attached as shown in FIG. 16. This embodiment works much in the same manner as the embodiments shown in FIGS. 11 and 12. When pressure is applied to nozzle 28, members 230 and 232 deform and flex to allow valve 28 to move in a downward motion and depress valve stem 62. Flexible strips 230 and 232 can be made from any material that has sufficient rigidity and flexibility so that strips 230 and 232 will support the outer shells when no pressure is applied to the top surface 38 but will deform or bend under pressure to actuate the spray valve. The material should also return to its original configuration when pressure is removed.

INDUSTRIAL APPLICABILITY

The present invention relates to articles of manufacture for use primarily by consumers to remove or mask odors in the air or to perfume an environment.

The present invention has been described with reference to the above preferred embodiments. However, the scope of this invention is only limited by the attached claims.

What is claimed is:

1. A refill package for use within an outer shell having guide means, comprising: a spray container having a can body and a valve which includes s valve stem; a base, and an exterior shroud into which the spray container is inserted, the shroud having a spray nozzle and means to lock the spray container position so that the valve stem is in communication with the spray nozzle, flexing means being attached to the spray container by means of the shroud, the spray nozzle being fitted over the container in fluid communication with the valve stem, the spray nozzle being attached to the can body by the flexing means; the flexing means having a sufficient range of motion to allow the valve to be actuated when pressure is applied to the spray nozzle and wherein the shroud cooperates with the guide means to allow the shell to slide smoothly relative to the refill cartridge when pressure is applied to a top surface of the shell.

2. The refill package of claim 1, wherein the spray container is a pump spray container having a pump spray valve.

3. The refill package of claim 1, wherein the flexing means include flexible strips.

4. The refill package of claim 1, wherein the flexing means include hinges.

5. The refill package of claim 1, wherein the hinges are three point hinges.

6. The refill package of claim 1, wherein the spray container is an aerosol container having an aerosol spray valve.

7. The refill package of claim 6, wherein the aerosol spray valve is a metering spray valve.

8. A spray dispensing package comprising: an outer shell; and a refill cartridge that fits within the outer shell, the refill cartridge including a spray container having a can body and a spray valve which includes a valve stem; wherein the refill cartridge has a base, and a spray nozzle, the spray nozzle being fitted over the container in fluid communication with the valve stem, the spray nozzle being attached to the can body by flexing means; the shell having a top surface and an opening in the top surface to receive the spray nozzle such that a spray can exit the spray nozzle to the atmosphere and such that the shell is supported by the refill cartridge; the flexing means having a sufficient range of motion to allow the spray valve to be actuated when pressure is applied to the top surface of the shell; the shell further having guide means which cooperate with the refill cartridge to allow the shell to slide smoothly relative to the refill cartridge when pressure is applied to the top surface of the shell.

9. The spray dispensing package of claim 8 wherein the outer shell has exterior ornamentation.

10. The spray dispensing package of claim 8 wherein the spray container is a pump spray valve.

11. The spray dispensing package of claim 8 wherein the flexing means include flexible strips.

12. The spray dispensing package of claim 8 wherein the flexing means include hinges.

13. The spray dispensing package of claim 12 wherein the hinges are three point hinges.

14. The spray dispensing package of claim 8 wherein the refill cartridge has an exterior shroud into which the spray container is inserted, the shroud having means to lock the spray container position so that the valve stem is in communication with the spray nozzle, the flexing means being attached to the spray container by means of the shroud.

15. The spray dispensing package of claim 14 wherein the shroud is dimensioned to slide smoothly past the guide means.

16. The spray dispensing package of claim 8 wherein the spray container is an aerosol container having an aerosol spray valve.

17. The spray dispensing package of claim 16 wherein the aerosol spray valve is a metering spray valve.

* * * * *